US007913359B2

(12) United States Patent
Duan et al.

(10) Patent No.: US 7,913,359 B2
(45) Date of Patent: Mar. 29, 2011

(54) AUTOMATICALLY OPENING HINGE ASSEMBLY FOR PORTABLE ELECTRONIC DEVICES

(75) Inventors: Chao Duan, Shenzhen (CN); Chia-Hua Chen, Taipei Hsien (TW)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 419 days.

(21) Appl. No.: 12/133,520

(22) Filed: Jun. 5, 2008

(65) Prior Publication Data

US 2009/0165250 A1 Jul. 2, 2009

(30) Foreign Application Priority Data

Dec. 29, 2007 (CN) ..... 2007 1 0203549

(51) Int. Cl.
*E05D 11/10* (2006.01)

(52) U.S. Cl. ..... 16/330; 16/277; 16/285; 16/325; 16/340; 16/386

(58) Field of Classification Search ..... 16/250, 16/277, 284, 285, 325, 330, 339, 340, 341, 16/342, 386; 455/575.1, 575.3; 379/433.11, 379/433.13

See application file for complete search history.

(56) References Cited

U.S. PATENT DOCUMENTS

| | | | | |
|---|---|---|---|---|
| 6,952,860 | B2 * | 10/2005 | Kawamoto | 16/285 |
| 7,100,239 | B2 * | 9/2006 | Duan et al. | 16/303 |
| 7,117,562 | B2 * | 10/2006 | Zuo et al. | 16/303 |
| 7,117,563 | B2 * | 10/2006 | Chen et al. | 16/330 |
| 7,124,472 | B2 * | 10/2006 | Duan et al. | 16/303 |
| 7,353,568 | B2 * | 4/2008 | Duan et al. | 16/330 |
| 7,383,616 | B2 * | 6/2008 | Duan et al. | 16/303 |
| 2004/0181909 | A1 * | 9/2004 | Kawamoto | 16/330 |
| 2005/0172454 | A1 * | 8/2005 | Chen et al. | 16/330 |
| 2005/0188504 | A1 * | 9/2005 | Duan et al. | 16/330 |
| 2006/0096063 | A1 * | 5/2006 | Duan et al. | 16/303 |
| 2006/0174443 | A1 * | 8/2006 | Takagi et al. | 16/330 |
| 2006/0200945 | A1 * | 9/2006 | Lu et al. | 16/340 |
| 2006/0242795 | A1 * | 11/2006 | Duan et al. | 16/330 |
| 2006/0242796 | A1 * | 11/2006 | Duan et al. | 16/330 |
| 2006/0254026 | A1 * | 11/2006 | Duan et al. | 16/330 |
| 2008/0201900 | A1 * | 8/2008 | Kubota | 16/221 |

* cited by examiner

*Primary Examiner* — Shane Bomar
*Assistant Examiner* — Roberta Delisle
(74) *Attorney, Agent, or Firm* — Steven M. Reiss

(57) ABSTRACT

A hinge assembly (100) includes a shaft (13), a cam (14), a follower (15), a first spring (12), a control member (17), a second spring (16), and a fixing seat (18). The shaft defines a thread (1311). The cam has a cam surface (146), a cam hole (141) and an inner circumferential surface. The inner circumferential surface includes a protrusion (142) configured engaged the thread of the shaft. The control member has at least one reverse slot (173). The circumferential surface includes at least one block (184). The at least one block is received in the at least one reverse slot of the control member so as to lock the control member into the fixing seat. The hinge assembly allows for the automatic opening and closing of the device to which the hinge assembly is incorporated.

17 Claims, 11 Drawing Sheets

AUTOMATICALLY OPENING HINGE ASSEMBLY FOR PORTABLE ELECTRONIC DEVICES

BACKGROUND OF THE INVENTION

1. Field of the Invention

The present invention relates to hinge assemblies and, particularly, to an automatically opening hinge assembly for foldable devices such as portable telephones, portable computers, and so on.

2. Discussion of the Related Art

At present, perhaps the most popular mobile phone in the marketplace is the foldable mobile phone, which generally includes a cover section and a body section. The cover section and the body section are rotatably interconnected through a hinge assembly, for switching the telephone between an in-use position and a closed position.

Typically, the hinge assembly employs a cam and a follower, which allows the cover section to fold outwards from the body section and then hold in an open position. The hinge assembly typically includes a cam having a concave portion, a follower having a convex portion, a shaft having a fixing end, and a spring. The cam and the follower are placed around the shaft. The spring resists the follower allowing the concave portion to tightly contact with the convex portion. The cam, the follower, the shaft and the spring are received in a housing. A cover rotates about a main body of the mobile phone by overcoming the force of the spring, thus allowing the concave portion to rotate about the convex portion. However, a user must open the mobile phone using both hands. This makes the mobile phone inconvenient to use in situations when the user has only one hand free.

Therefore, a new hinge mechanism is desired in order to overcome the above-described problems.

BRIEF DESCRIPTION OF THE DRAWINGS

Many aspects of the hinge assembly can be better understood with reference to the following drawings. The components in the drawings are not necessarily to scale, the emphasis instead being placed upon clearly illustrating the principles of the present hinge assembly. Moreover, in the drawings, like reference numerals designate corresponding parts throughout the several views.

DETAILED DESCRIPTION OF THE EMBODIMENTS

Figure 1:
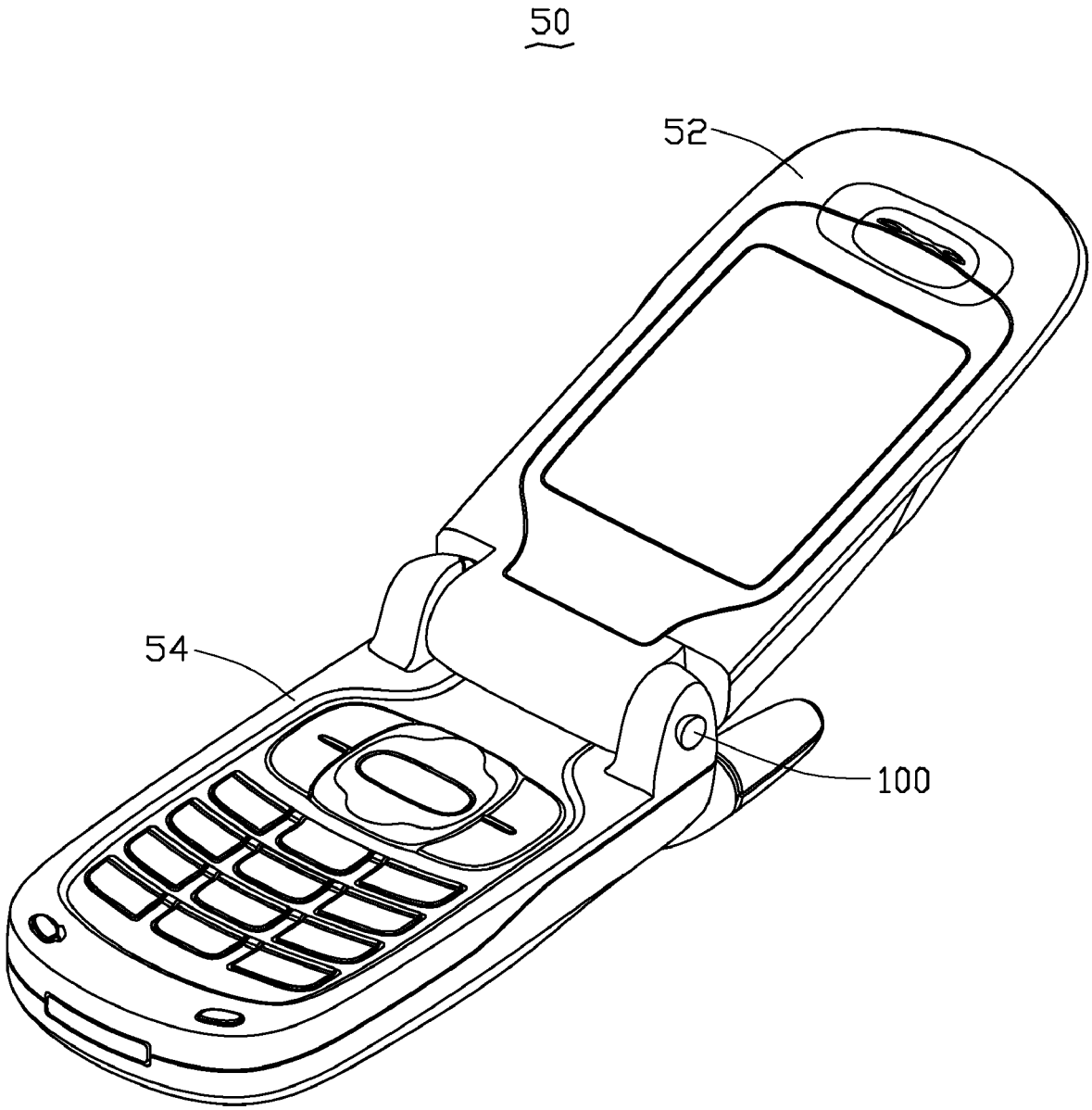
FIG. 1 is an isometric view of an exemplary embodiment of the present hinge assembly, as used in a mobile phone.

FIG. 1 shows a hinge assembly 100, applied to an exemplary foldable electronic device 50 such as a flip type mobile phone, for pivotably coupling a cover section 52 and a body section 54. It is to be understood, however, that the hinge assembly 100 could be advantageously used in other environments (e.g. cabinet doors). As such, the hinge assembly 100 should not be considered limited in scope solely to foldable electronic devices.

Figure 2:
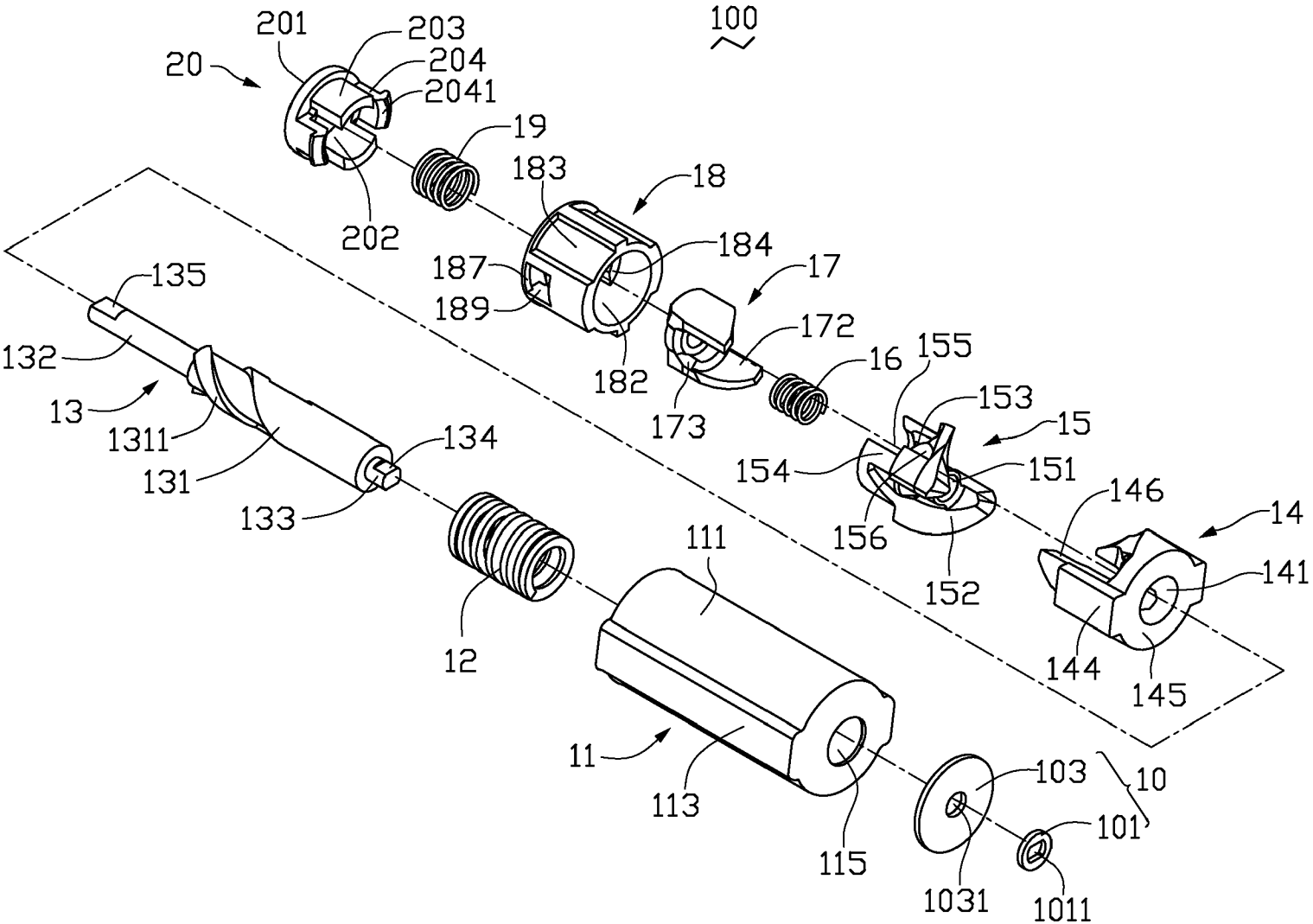
FIG. 2 is an exploded, isometric view of the exemplary embodiment of the hinge assembly shown in FIG. 1.
Figure 3:
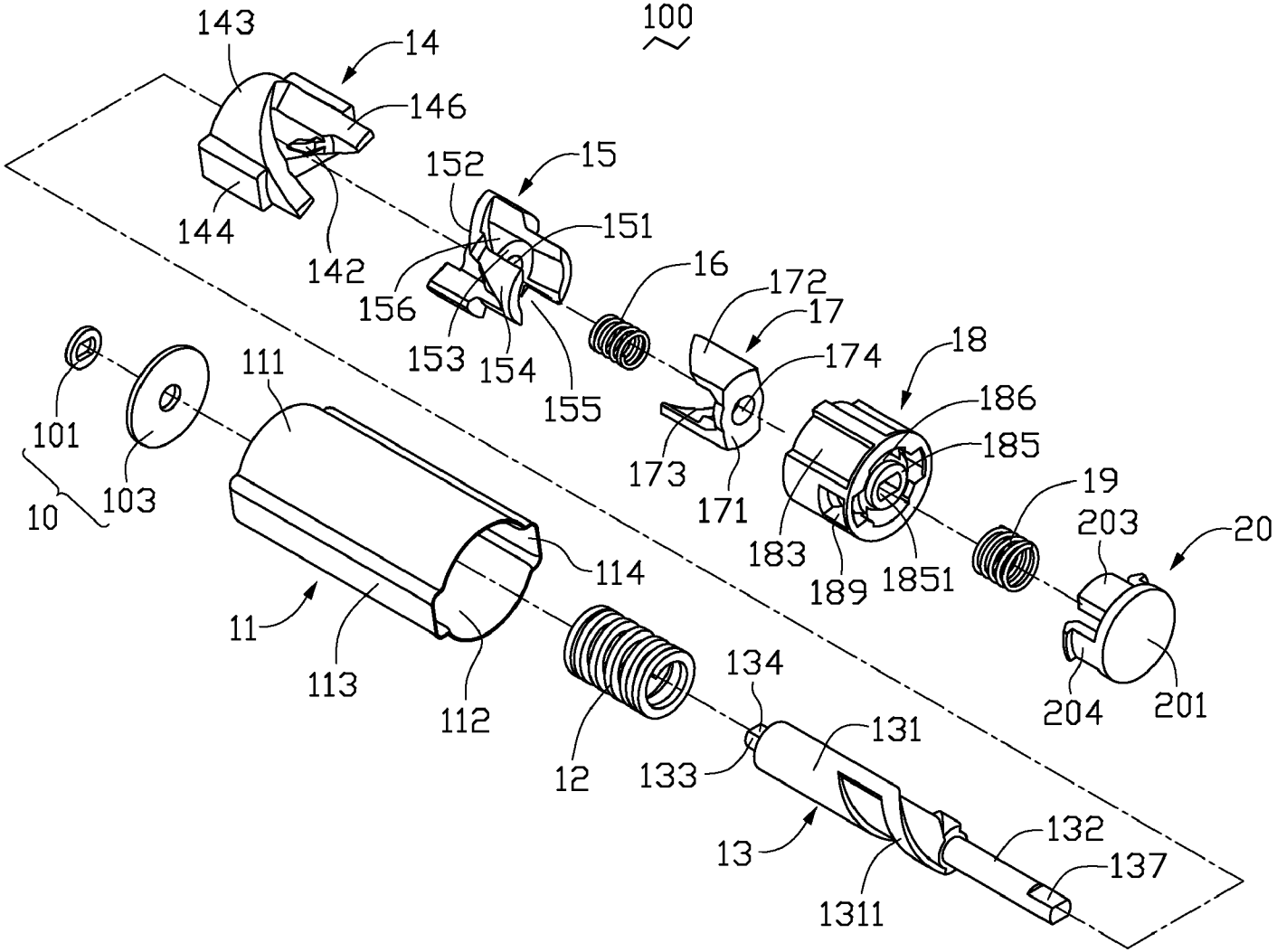
FIG. 3 is similar to FIG. 2, but viewed from another aspect.

Referring to FIGS. 2 and 3, the hinge assembly 100 of the present embodiment includes a securing structure 10, a sleeve 11, a first spring 12, a shaft 13, a cam 14, a follower 15, a second spring 16, a control member 17, a fixing seat 18, a return spring 19 and a pressing element 20. The first spring 12 and the cam 14 surround the shaft 13 at one end. The follower 15, the second spring 16, and the control member 17 are positioned on the other end of the shaft 13 opposite to the cam 14, in the order written. The sleeve 11 receives the above-mentioned elements. The securing structure 10 is fixed on one end of the shaft 13 with the cam 14, and the fixing seat 18 is fixed on the other end of the shaft 13. The pressing element 20 is further received in the fixing seat 18. Accordingly, the hinge assembly 100 is thus integrated into a single assembly.

The securing structure 10 includes a washer 101 and an anti-friction element 103. The washer 101 and the anti-friction element 103 are substantially disk-shaped. The washer 101 defines a square hole 1011 in a central area thereof. The anti-friction element 103 defines a circular/round hole 1031 in a central area thereof.

The sleeve 11 is substantially a hollow cylinder having an outer wall 111 and an inner wall 112. Two troughs 114 are defined in an inner wall 112 of the sleeve 11 along a longitudinal direction thereof. Two sleeve blocks 113 formed on the outer wall 111 correspond to the troughs 114. The sleeve blocks 113 engage the cover section 52 of the mobile phone 50 so that the sleeve 11 and the cover section 52 cannot rotate relative to each other. The sleeve 11 includes an open end and a partially-closed end. The partially-closed end of the sleeve 11 defines a through-hole 115 at a central area thereof.

The first spring 12 is a cylindrical helical spring (i.e., occupying a cylindrical volume). The first spring 12 is sized to be received in the sleeve 11.

The shaft 13 sequentially includes a shaft portion 132, a screw portion 131 and an end portion 133. The end portion 133 is sized to extend through the through-hole 115. The end portion 133 has a retaining end 134 at a distal end thereof. The washer 101 and the anti-frictional element 103 of securing structure 10 may be placed around the retaining end 134. A sectional configuration of the retaining end 134 corresponds with the square hole 1011, in which, the retaining end 134 may be locked into the square hole 1011 of the washer 101. The screw portion 131 is located between the end portion 133 and the shaft portion 132. The screw portion 131 is substantially cylindrical, and partially defines a thread 1311 thereon. The thread 1311 is a raised helical or spiral rib/ridge defined on the surface of shaft 13. A diameter of the shaft portion 132 is smaller than that of the first spring 12. The shaft portion 132 is cylindrical in shape, and has a flat surface at a free end thereof forming a flat portion 135.

Figure 4:
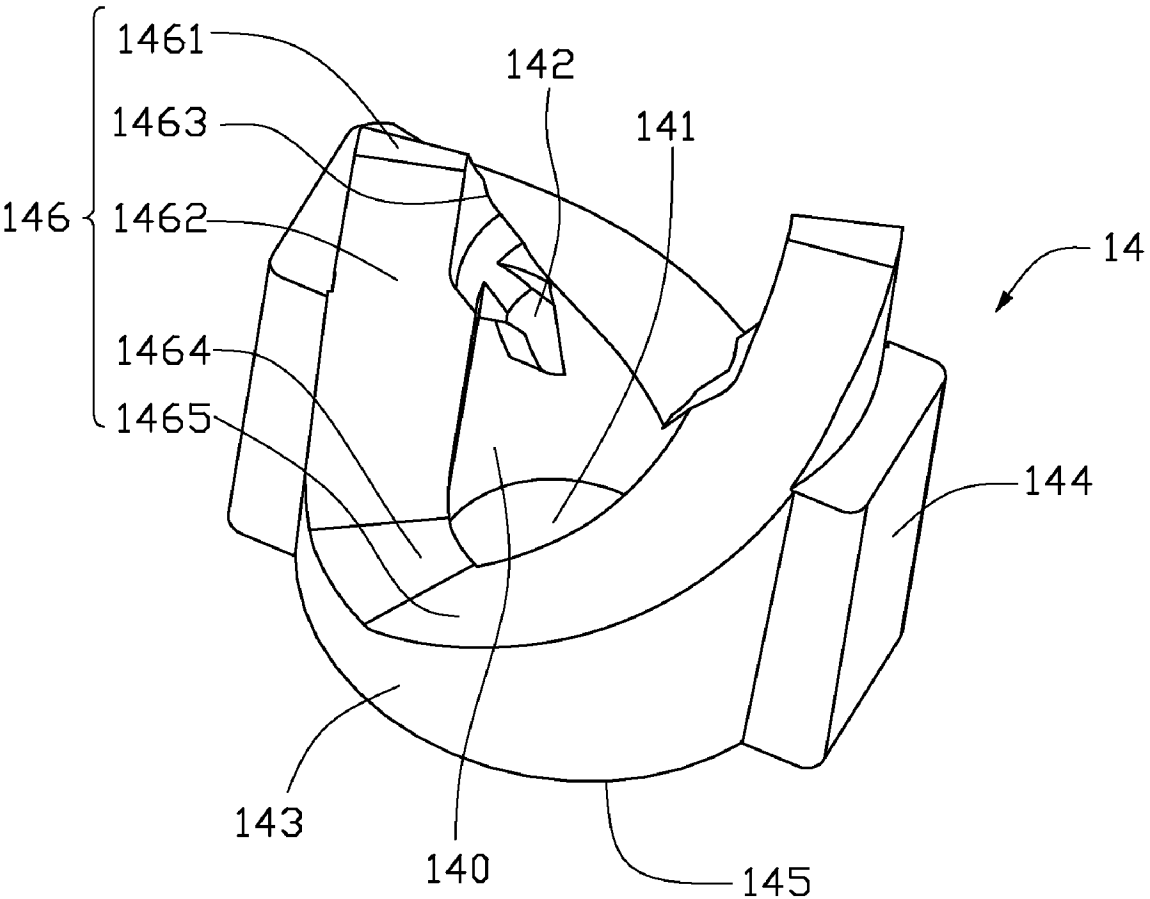
FIG. 4 is an enlarged view of the cam in FIG. 2.

Referring to FIG. 4, the cam 14 includes an outer surface 143, an inner surface 140 and an axis hole 141. The diameter of the outer surface 143 substantially equals that of the sleeve 11. The outer surface 143 includes two symmetric latching blocks 144 slidably received in the trough 114 of the sleeve 11 so the cam 14 may be non-rotatably received in the sleeve 11. A diameter of the axis hole 141 is substantially equal to that of the screw portion 131 of the shaft 13. The inner surface 140 includes a protrusion 142 adjacent to one end of the cam 14. The protrusion 142 has a substantially prismatic shape and configured for interacting with the thread 1311 of the screw portion 131 so that the protrusion 142 may slide and rotate along the thread 1311 when shaft 13 is rotated. One end of the cam 14 has a cam surface 146, and the other end thereof has an end surface 145. The cam surface 146 includes two symmetric peaks 1461 and two symmetric valleys 1464. A vertical surface 1462, a buffering surface 1463, and a slope surface 1465 connected to each other are formed between the two valleys 1464. The two peaks 1461 are respectively formed between the buffering surface 1463 and the vertical surface 1462.

Figure 5:
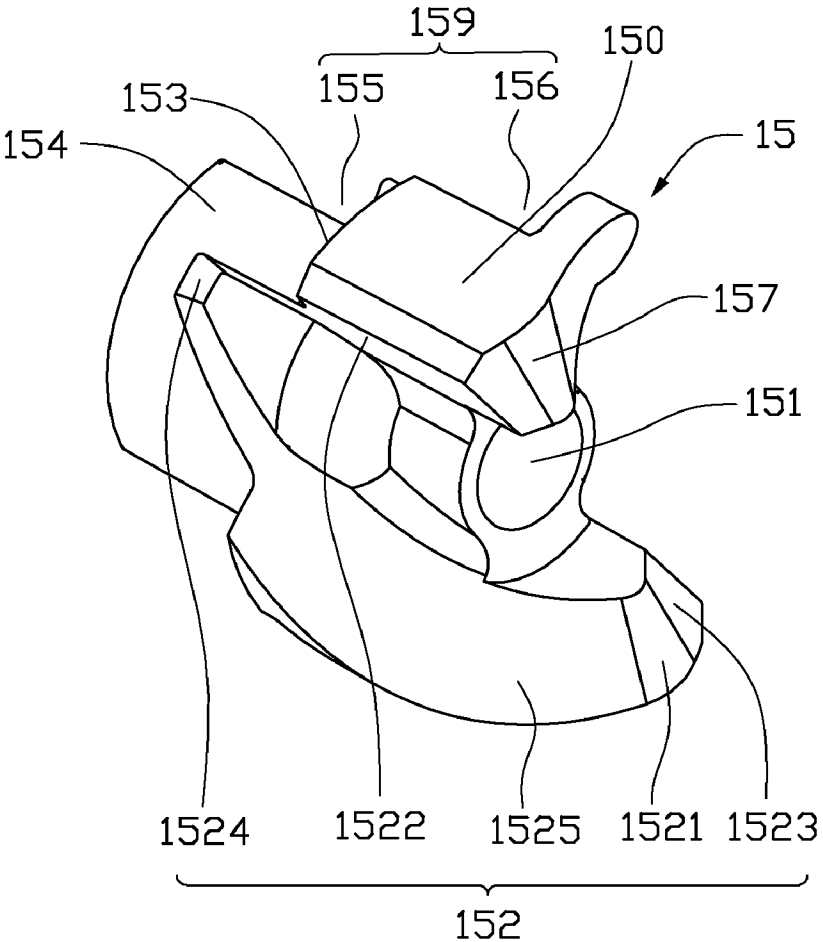
FIG. 5 is an enlarged view of the follower in FIG. 2.

Referring to FIG. 5, the follower 15 includes a cylindrical outer wall 150, a first end 153 and a second end 157. Two extending walls 154 extend away from the first end 153 of the follower 15. Two notches 155 are defined between the extending walls 154. The outer wall 150 defines two inclined slots 156 respectively corresponding to a notch 155. The inclined slot 156 with the notch 155 cooperatively define a first reverse groove 159. The second end 157 of the follower 15 has a latching cam surface 152. The latching cam surface 152 includes two symmetric peaks 1521 and two symmetric valleys 1524, and engages with the cam surface 146 of the cam 14. A slant surface 1525, a buffering surface 1523, and a perpendicular surface 1535 are defined between two valleys 1533.

The second spring 16 is substantially cylindrical and sized to be placed around the shaft 13.

The control member 17 has a disk-shaped body portion 171. Two opposite wedge walls 172 extend from a peripheral wall of the body 171, thereby forming two opposite second reverse slots 173 at one side thereof. Each wedge wall 172 may be received in a corresponding first revere slot 159 of the follower 15, and each extending wall 154 of the follower 15 may be received in a corresponding second reverse slot 173. A central hole 174 is defined in the body portion 171 so that the shaft portion 132 may pass through the central hole 174 of the control member 17.

Figure 6:
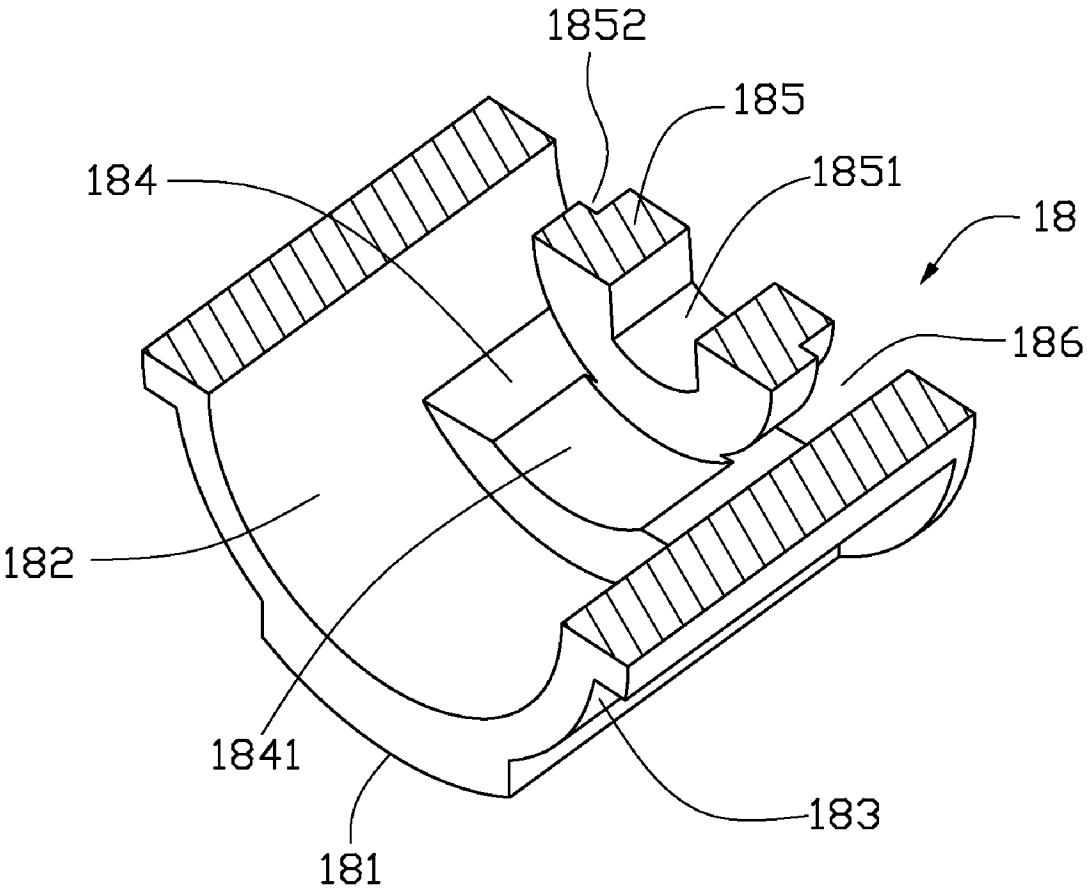
FIG. 6 is a cross-sectional view of the fixing seat in FIG. 2.
Figure 7:
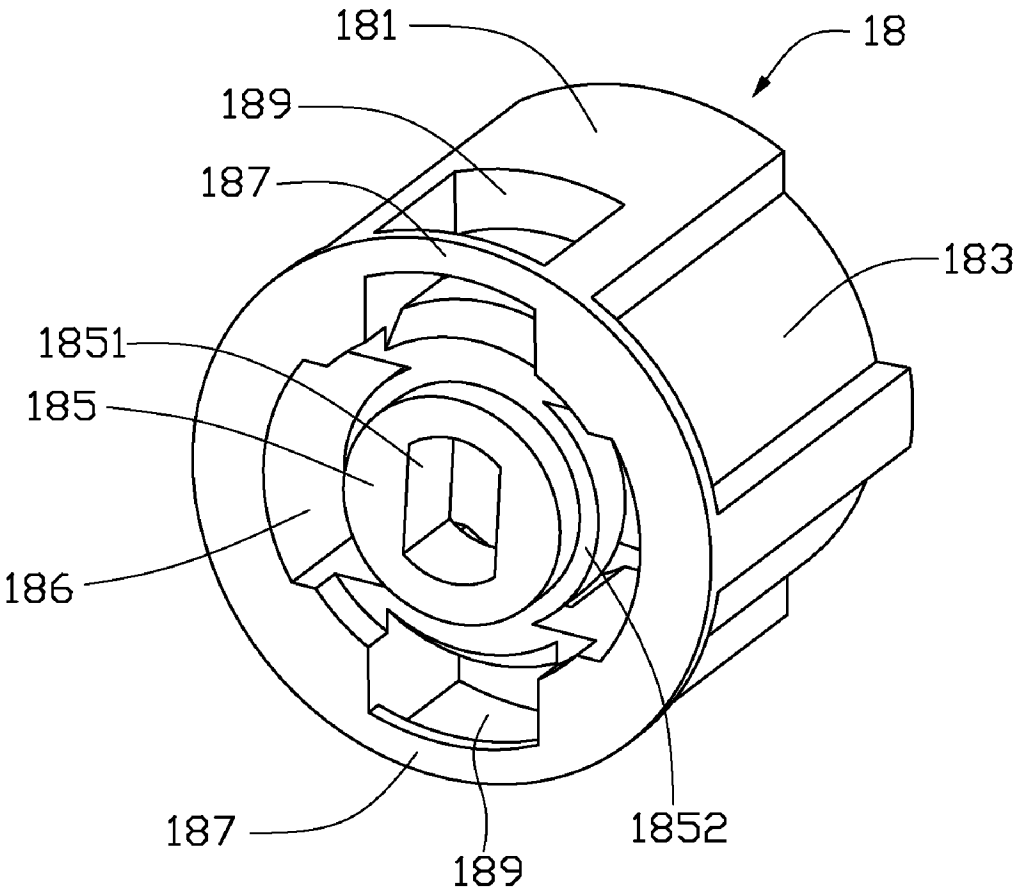
FIG. 7 is an enlarged view of the fixing seat in FIG. 2.
Figure 8:
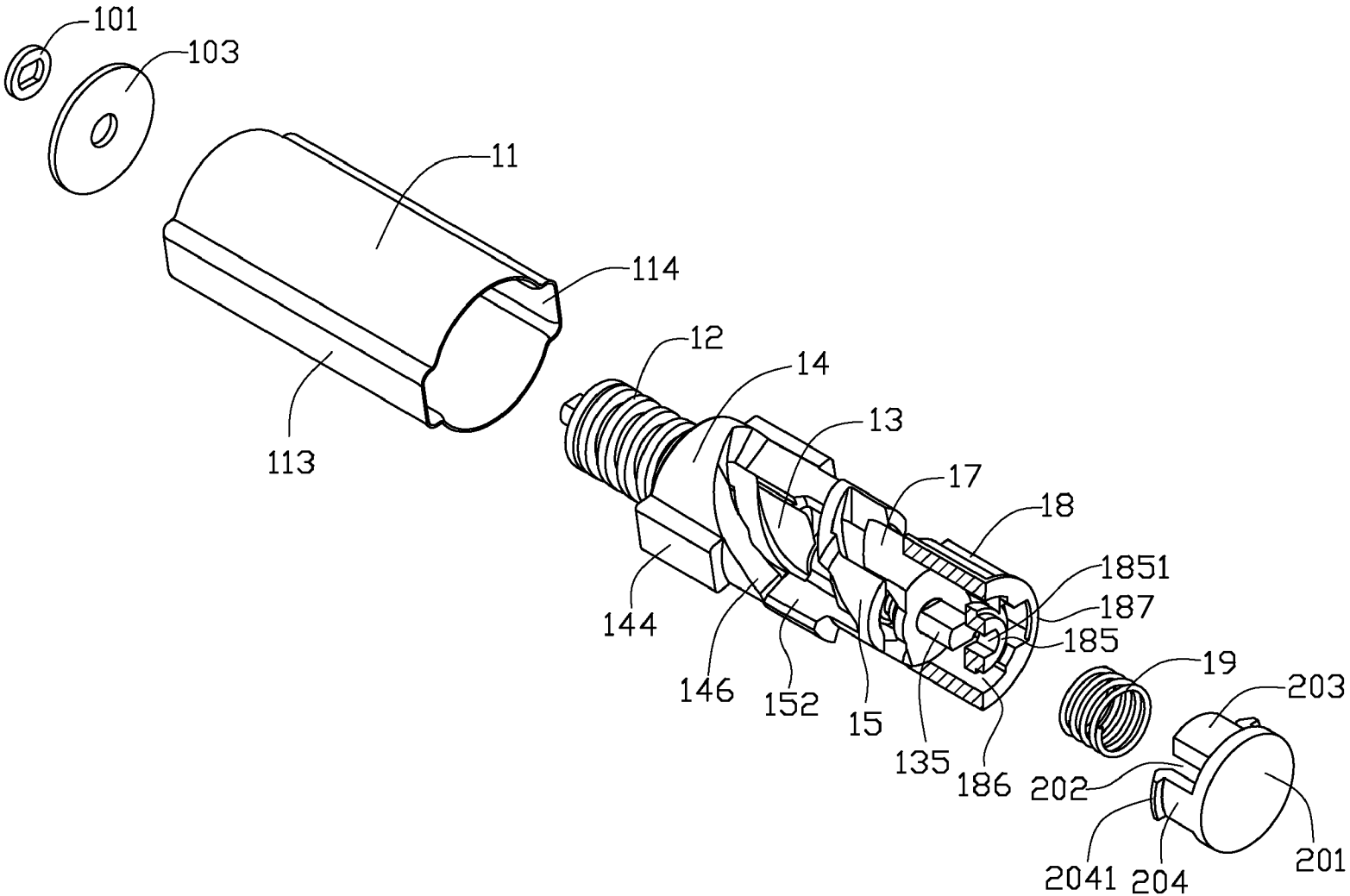
FIG. 8 is an partially assembled view showing the hinge assembly in FIG. 2.
Figure 9:
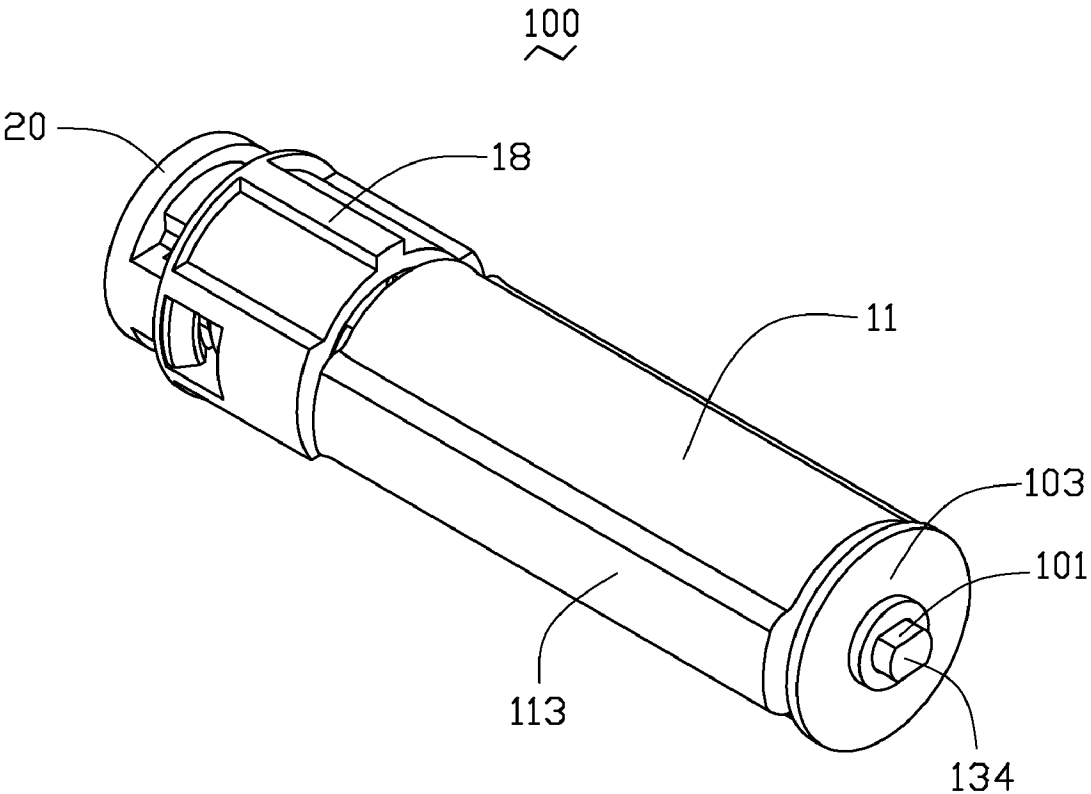
FIG. 9 is an assembled view showing the hinge assembly in FIG. 2.
Figure 10:
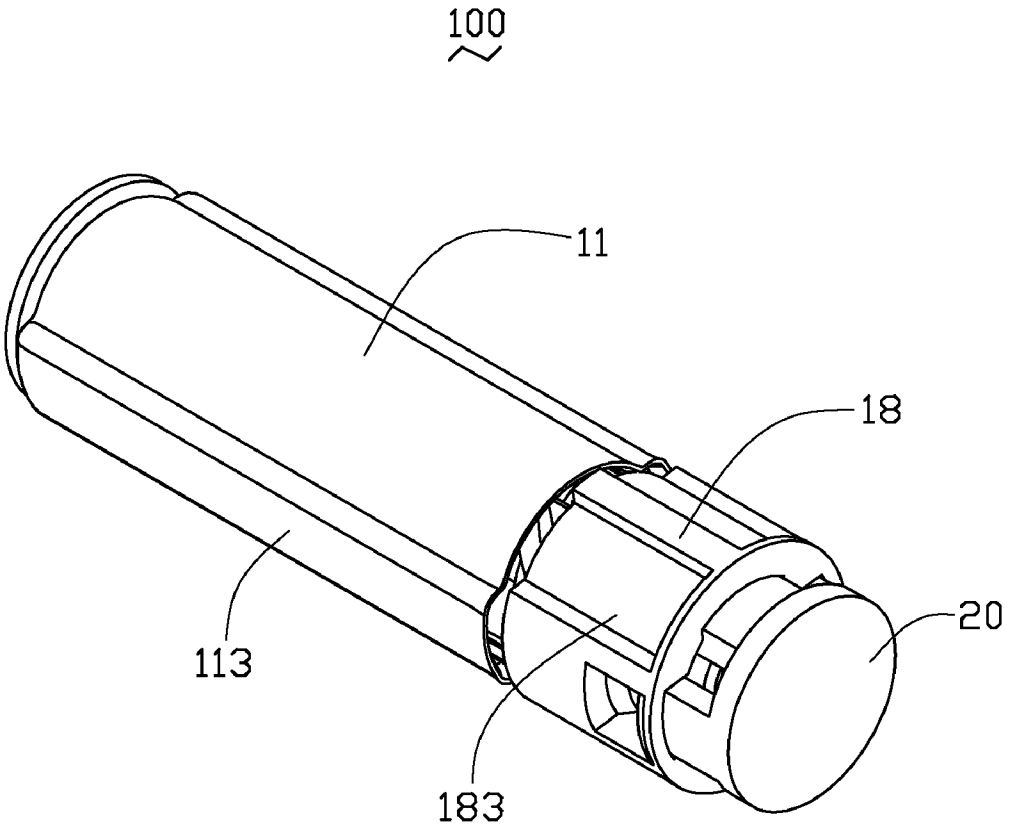
FIG. 10 is similar to FIG. 9, but viewed from another aspect.
Figure 11:
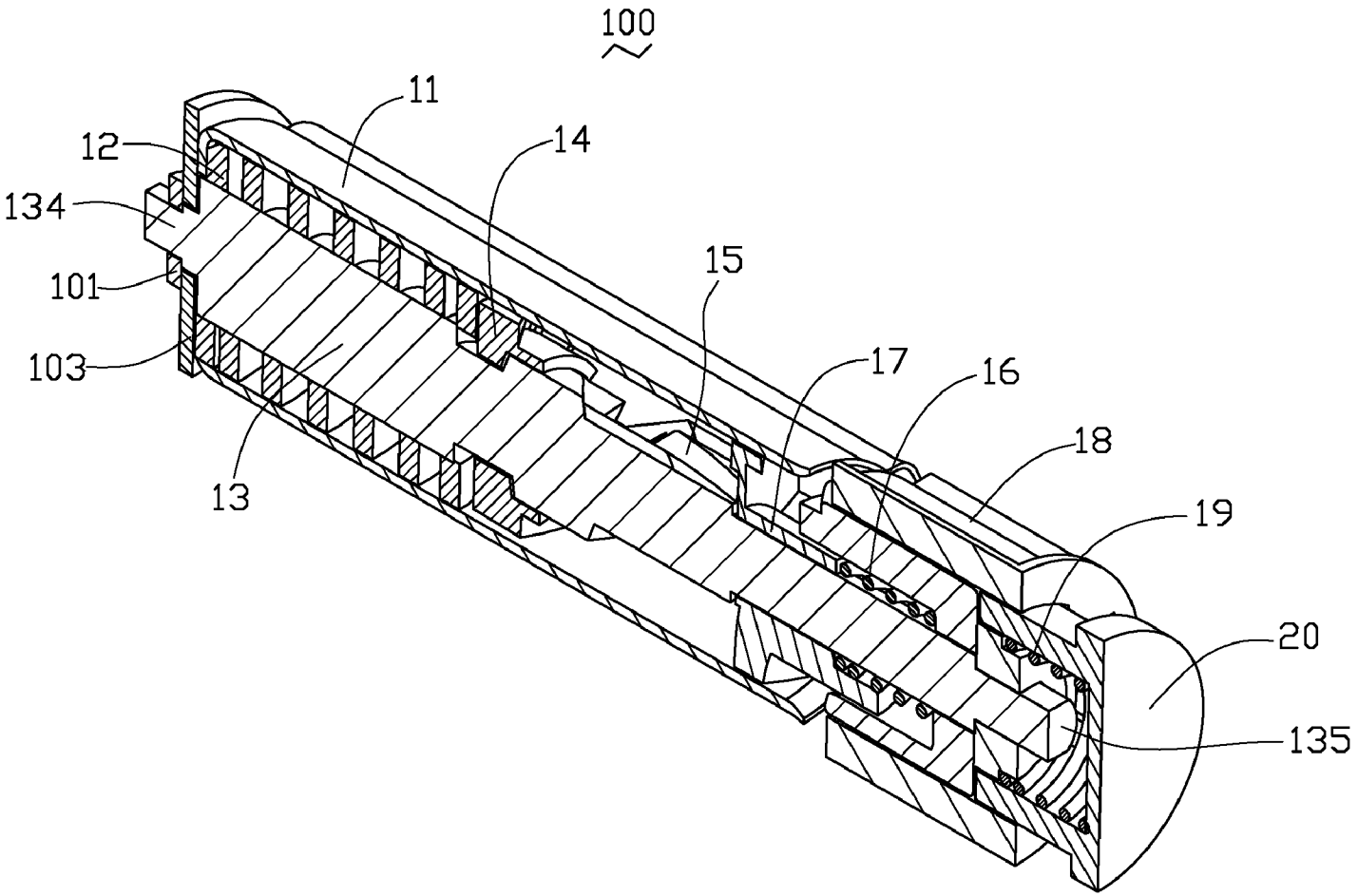
FIG. 11 is a cut-away view of FIG. 10 along X-X line.

Referring to FIGS. 6 and 7, the fixing seat 18 has an outer circumferential wall 181, an inner circumferential wall 182 and two open ends (partially shown). The outside circumferential wall 181 defines four fixing grooves 183 so that the fixing seat 18 can be fixedly retained in the cover section 52 of the foldable electronic device 50. The outside circumferential wall 181 defines two guide cutouts 189. Adjacent to each of the guide cutout 189, two opposite ribs 187 are formed at one end of the fixing seat 18. Two symmetric spaced arcuate blocks 184 are formed in the inner circumferential wall 182 and each engages a corresponding second reverse slot 173. Each arcuate block 184 has an inner wall 1841. A cylindrical connecting portion 185 is formed between the arcuate blocks 184. Two insert holes 186 are defined between the inner circumferential wall 182 and the connecting portion 185. The connecting portion 185 defines a deformed hole 1851 in a central area thereof. The shape and the size of the deformed hole 1851 correspond to the flat portion 137 of the shaft portion 132. A step 1852 is formed at an outer circumferential wall of the connecting portion 185.

The return spring 19 is substantially cylindrical. One end of the return spring 19 resists the step 1852 of the connecting portion 185, and the other end resists the pressing element 20.

The pressing element 20 includes a disk-shaped body 201, and two opposite arms 203 extending from the body 201 along a longitudinal direction thereof. Two guide portions 204 extend from the body 201 along an axial direction thereof. Each guide portion 204 includes a clasp 2041 at a distal end thereof. The clasps 2041 may clamp to the rib 187 of the fixing seat 18 to prevent the pressing element 20 from separating from the fixing seat 18. The arms 203 and the guide portions 204 cooperatively form a cylindrical receiving space 202. The receiving space 202 is sized for receiving the return spring 19 therein.

In assembly, referring to FIGS. 8 to 11, the cam 14 is placed around the screw portion 131, with the protrusion 142 of the cam 14 engaging with the thread 1311 of the shaft 13. The cam surface 146 faces the flat portion 135.

The follower 15 passes over the shaft portion 132 of the shaft 13, with the latching cam surface 152 of the follower 15 engaging with the cam surface 146 of the cam 14. The second spring 16 is placed around the shaft 13, with one end of the second spring 16 resisting with one end of the follower 15. Then, the central hole 174 of the control member 17 is placed around the shaft portion 132. The wedge walls 172 of the control member 17 engage in the first reverse slots 159 of the follower 15 between the extending walls 154, and the extending walls 154 of the follower 15 are then inserted into the second reverse slots 173 of the control member 17 to lock the control member 17 with the follower 15.

The fixing seat 18 is then placed around the control member 17. The flat portion 135 of the shaft portion 132 of the shaft 13 extends out from the deformed hole 1851 of the fixing seat 18. The arcuate blocks 184 of the fixing seat 18 engage in the second reverse slots 173 of the control member 17, thereby limiting the rotation of the control member 17 relative to the fixing seat 18.

The return spring 19 is received in the receiving space 202. Then, the pressing element 20 with the return spring 19 is disposed in the fixing seat 18. The return spring 19 resists the step 1852 of the fixing seat 18. At the same time, the guide portions 204 are pressed and inserted into the guide cutouts 189. Accordingly, the arms 203 are received in the inserted hole 186 of the fixing seat 18. After the guide portions 204 are released, the clasps 2041 clamp the ribs 187 of the fixing seat 18. The return spring 19 has a predetermined elastic force. Accordingly, the above elements are fixed to the shaft 13.

The first spring 12 is placed around the screw portion 131 of the shaft 13. The above-mentioned assembled elements are received into the sleeve 11 along one end of the assembled elements with the first spring 12. The latching blocks 144 of the cam 14 engage in the trough 114 of the sleeve 11, and the retaining end 134 extends out from the partially-closed end of the sleeve 11. Finally, the anti-friction element 103 is placed around the retaining end 134 of the shaft 13, and the washer 101 is tightly locked on the retaining end 134. The hinge assembly 100 is thus completely assembled.

To incorporate the self-contained component into a mobile phone during manufacturing, the sleeve 11 engages in a cavity (not shown) of the cover section 52 of the mobile phone 50, and the fixing seat 18 connects with the body section 54 of the mobile phone 50. When the cover section 52 of the mobile phone 50 is in a fully open position, the peaks 1461 of the cam 14 resist the valleys 1524 of the follower 15. The protrusion 142 engages in the thread 1311. The first spring 12 exerts a predetermined pressure on the cam 14 so that the cam 14 should rotate relative to the outer screw thread 1320 of the shaft 13. However, the follower 15 and the control member 17 prevent the cam 14 from rotating.

In use, when the cover section 52 of the mobile phone 50 is being closed, the cover section 52 can be closed by hand by pushing the sleeve 11 to rotate relative to the body section 54. The sleeve 11 further brings the cam 14 to rotate along the thread 1311 of the shaft 13. Due to the control member 17 being locked into the arcuate blocks 184 of the fixing seat 18, the control member 17 cannot rotate relative to the fixing seat 18. Accordingly, the follower 14 does not rotate relative to the fixing seat 18. When the cam 14 rotates, the protrusion 142 of the cam 14 break away from the thread 1311 of the shaft. The cam surface 146 of the cam 14 slides and rotates relative to the latching cam surface of the follower 15. The cam 15 is then pushed towards the button 20. When the peaks 1461 of the cam 14 slide to passes over the peaks 1521 of the follower 15 and stay on the buffering surface 1523, the first spring 12 accumulates elastic potential energy. At that time, the cover section 52 becomes closed relative to the body section 54 of the mobile phone 50. The protrusion 142 is spaced from the thread 1311 of the shaft 13.

When a user wants to open the cover section 52 of the mobile phone 50 automatically, he/she may only hold the mobile phone 50 and press the pressing element 20 by one hand. In this process, the pressing element 20 moves along an axial direction of the shaft 13, the arms 204 of the pressing element 20 then push the control member 17 to move away from the pressing element 20 in the axial direction of the shaft 13. The control member 17 moves axially, compressing the second spring 16 towards the cam 14. When the wedge walls 172 of the control member 17 break away from the limitation of the arcuate blocks 184 of the fixing seat 18, the cam 14 then rotates relative to the shaft 13 along the thread 1311 under elastic energy of the first spring 12. After the pressing element 20 is released, the return spring 19 allows the pressing element 20 return to an original state.

When the cam 14 rotates, the peaks 1461 of the cam surface 146 slide downward from the buffering surface 1523 of the follower 15 until the peaks 1461 contact with the valleys 1524 of the follower 15. The gap between the protrusion 142 and the thread 1311 is eliminated. Accordingly, the protrusion 142 is engaged with the thread 1311 of the shaft 13. When the cam 14 rotates and slides relative to the shaft 13, the follower 15, the second spring 16 and the control member 17 together move and rotate. Furthermore, the sleeve 11 rotates with the cam 14 so that the cover section 52 of the mobile phone 50 is opened. Whilst the sleeve 11 rotates relative to the shaft 13, the anti-friction element 103 directly contacts the washer 101. The anti-friction element 102 may greatly decrease the abrasion between the sleeve 11 and the washer 101.

The cam 14 stops rotating when the cover section 52 of the mobile phone 50 is completely opened. The elastic potential energy of the second spring 16 then pushes the control member 17 to move toward the pressing element 20. Accordingly, the wedge walls 172 of the control member 17 are locked between the blocks 184 of the fixing seat 18. The hinge assembly 100 may be opened manually. The principles of the manual opening process are basically the same as the manual closing process.

In an alternative embodiment, the first spring 12, the second spring 16 and the return spring 19 may be replaced by other elastic elements such as an elastic sponge.

Understandably, the thread number of the shaft may be more than two. Accordingly, the number of the protrusion in the cam corresponds to the thread number. If the thread of the screw portion is a single thread, the protrusion of the cam may be two. The axial and radial distance between the protrusions, beneficially, corresponds to the thread distance of the shaft so that the two protrusions may engage in the thread of the shaft.

As described above, the present embodiment provides a hinge assembly 100 for use with various portable devices, beyond the mobile phone illustrated, and/or with other devices needing a hinge assembly that selectably facilitates the achievement of fully open and fully closed positions.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A hinge assembly for being rotated between an opened state and a closed state, comprising:

a shaft defining a thread;

a cam having a cam surface at one end thereof, the cam defining a cam hole and an inner circumferential surface, the inner circumferential surface including a protrusion, the protrusion spaced from the thread of the shaft when the hinge assembly is in the closed state;

a follower having a latching cam surface engaging with the cam surface of the cam;

a first spring causing the cam surface of the cam and the latching cam surface of the follower to resist each other;

a control member having at least one reverse slot;

a second spring positioned between the control member and the follower; and a fixing seat placed around the control member, the fixing seat having an inner circumferential wall, the inner circumferential wall including at least one block; the at least one block being received in the at least one reverse slot of the control member so as to lock the control member into the fixing seat;

wherein when the control member is released from the fixing seat, the control member and the cam are movable relative to the fixing seat to allow the protrusion to engage the thread of the shaft to automatically rotate the cam under the force of the first spring to the open state.

2. The hinge assembly as claimed in claim 1, further comprising a press element, wherein the press element has at least one arm, the at least one arm is received in the fixing seat and resists the control member, the press element being pressable to drive the control member away from the fixing seat to allow the fixing seat to release the control member, which results in the cam together with the follower and the control member to rotate along the thread of the shaft under urging of the first spring.

3. The hinge assembly as claimed in claim 2, wherein there are two arms, the fixing seat defines two insert holes, and each arm is received in a corresponding insert hole of the fixing seat and resists the control member.

4. The hinge assembly as claimed in claim 1, further comprising a securing structure, the securing structure including an anti-friction element and a washer, the anti-friction element and the washer are fixed on the end of the shaft.

5. The hinge assembly as claimed in claim 1, wherein the shaft includes a shaft portion, a screw portion and an end portion, the screw portion positioned between the shaft portion and the end shaft portion.

6. The hinge assembly as claimed in claim 5, wherein the end portion has a retaining end at a distal end thereof, and a washer is placed around the retaining end.

7. The hinge assembly as claimed in claim 6, wherein the shaft portion is cylindrical, and has a flat surface forming a flat portion.

8. The hinge assembly as claimed in claim 1, further comprising a sleeve, wherein the sleeve includes an open end and a partially-closed end, the partially-closed end of the sleeve defining a through-hole at a central area thereof, the first spring, the cam, the follower, and the shaft are received in the sleeve, and one end the shaft extends from the through-hole of the sleeve.

9. The hinge assembly as claimed in claim 1, wherein the latching cam surface of the follower includes two peaks and two valleys, and a vertical surface, a buffering surface and a sloped surface are formed between one peak and one valley.

10. A hinge assembly of a foldable electronic device comprising a main body and a flip cover rotatably connected to each other, whereby the main body and the flip cover can be rotated relative to each other between an opened state and a closed state, the hinge assembly comprising:

a hinge shaft comprising a thread thereon;

a driving cam positioned around the hinge shaft, the cam having a protrusion formed on an inner periphery thereof, the protrusion selectively meshing with the thread in such a manner that the cam rotates relative to the hinge shaft upon being pushed axially, the cam having a first cam surface formed on one end thereof, the cam fixed relative to one of the main body and the flip cover;

a driven cam attached around the hinge shaft, the driven cam having a second cam surface engaging with the first cam surface; the second cam surface including a surface perpendicular to the axis of the hinge shaft;

an elastic member biasing against the driving cam toward the driven cam to longitudinally push the driving cam;

a fixing seat configured so as to be fixed relative to the other of the main body and the flip cover;

a control member fixed relative to the driven cam follower along a circumferential direction of the driving cam, the control member movable longitudinally between a locked position where the control member is engaged with the fixing seat to prevent the control member and the cams from rotating relative to the fixing seat, and the protrusion is spaced from the thread corresponding to the closed state of the foldable electronic device, and an unlocked position where the control member is released from the fixing seat and the control member and the cams are movable relative to the fixing seat to allow the protrusion to be engaged with the thread to automatically rotate the driving cam under the force of the elastic member to the open state of the foldable electronic device; and another elastic member biasing the control member toward the fixing seat.

11. The hinge assembly as claimed in claim 10, further comprising a sleeve, wherein the first spring and the cams are received in the sleeve, the shaft extending through the sleeve with opposite ends thereof exposed from ends of the sleeve, and the sleeve non-rotatably connecting with the driving cam.

12. The hinge assembly as claimed in claim 11, wherein the shaft includes a shaft portion, a screw portion and an end portion, the screw portion is positioned between the shaft portion and the end portion, the end portion has a retaining end at a distal end thereof, a securing structure disposed outside of the sleeve is fixed on the retaining end.

13. The hinge assembly as claimed in claim 10, wherein the control member comprises a pair of spaced wedge walls extending along an axial direction of the shaft and a pair of reverse slots formed between the wedge walls, and the fixing seat comprises a circumferential wall in which the control member is received, the wedge walls of the control member engage with the driven cam in the circumferential direction, two spaced arcuate blocks formed in an inner surface of the circumferential wall of the fixing seat and received in the respective reverse slots of the control member in the locked position to prevent the control member and the cams from rotating relative to the fixing seat.

14. The hinge assembly as claimed in claim 13, wherein the shaft portion is cylindrical and has a flat surface at a free end forming a flat portion.

15. The hinge assembly as claimed in claim 1, wherein the follower defines at least one notch and at least one inclined slot, the control member including two wedge walls and defining the at least one reverse slot, the wedge walls received in the at least one notch and the at least one inclined slot.

16. The hinge assembly as claimed in claim 1, wherein there are two blocks, a cylindrical connecting portion is formed on the receiving seat between the blocks, a step is formed at the connecting portion, and a return spring resists the step of the fixing seat.

17. The hinge assembly as claimed in claim 10, wherein the driving cam defines two notches and two inclined slots, the control member including two wedge walls and defining two reverse slots therebetween, and the wedge walls are received in the notches and the inclined slots.

* * * * *